US012250988B2

(12) United States Patent
Chang et al.

(10) Patent No.: US 12,250,988 B2
(45) Date of Patent: Mar. 18, 2025

(54) SOLE STRUCTURE FOR ARTICLE OF FOOTWEAR

(71) Applicant: NIKE, Inc., Beaverton, OR (US)

(72) Inventors: Leo S. Chang, Portland, OR (US); Fabricio Da Costa Pereira Machado, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 152 days.

(21) Appl. No.: 17/666,337

(22) Filed: Feb. 7, 2022

(65) Prior Publication Data

US 2022/0248804 A1 Aug. 11, 2022

Related U.S. Application Data

(60) Provisional application No. 63/146,953, filed on Feb. 8, 2021.

(51) Int. Cl.

| | |
|---|---|
| ***A43B 13/18*** | (2006.01) |
| ***A43B 13/12*** | (2006.01) |
| ***A43B 13/20*** | (2006.01) |

(52) U.S. Cl.

CPC ..... *A43B 13/187* (2013.01); *A43B 13/125* (2013.01); *A43B 13/20* (2013.01)

(58) Field of Classification Search

None

See application file for complete search history.

(56) References Cited

U.S. PATENT DOCUMENTS

| | | | | |
|---|---|---|---|---|
| 4,768,295 | A * | 9/1988 | Ito | A43B 13/18 36/28 |
| 4,817,304 | A * | 4/1989 | Parker | A43B 13/20 36/114 |
| 4,918,838 | A * | 4/1990 | Chang | A43B 13/203 36/28 |
| 5,313,717 | A * | 5/1994 | Allen | A43B 13/20 36/35 B |
| 5,528,842 | A * | 6/1996 | Ricci | A43B 21/30 36/38 |
| 6,684,532 | B2 * | 2/2004 | Greene | A43B 13/189 36/31 |
| 9,241,535 | B2 * | 1/2016 | Baudouin | A43B 13/141 |
| 2003/0172548 | A1 * | 9/2003 | Fuerst | A43B 13/026 36/28 |
| 2005/0102857 | A1 | 5/2005 | Yen | |

(Continued)

FOREIGN PATENT DOCUMENTS

EP 3771358 A1 2/2021

OTHER PUBLICATIONS

European Patent Office (ISA), International Search Report and Written Opinion for PCT App. No. PCT/US2022/015617, mailed May 13, 2022.

*Primary Examiner* — Jila M Mohandesi
(74) *Attorney, Agent, or Firm* — Honigman LLP; Matthew H. Szalach; Jonathan P. O'Brien

(57) ABSTRACT

A sole structure for an article of footwear includes an upper cushion extending from a first end to a second end, a lower cushion having a first segment attached to the upper cushion adjacent to the first end and including a tray extending towards the second end of the upper cushion, and at least one bladder disposed between the tray of the lower cushion and the upper cushion.

20 Claims, 8 Drawing Sheets

(56) References Cited

U.S. PATENT DOCUMENTS

| | | | | |
|---|---|---|---|---|
| 2012/0174432 | A1* | 7/2012 | Peyton | A43B 13/188 36/31 |
| 2014/0075777 | A1* | 3/2014 | Bruce | A43B 7/148 36/29 |
| 2014/0259747 | A1* | 9/2014 | Baudouin | A43B 13/181 36/28 |
| 2015/0027000 | A1* | 1/2015 | Barnes | A43B 13/183 36/87 |
| 2018/0168285 | A1* | 6/2018 | Cooper | A43B 13/187 |
| 2018/0213886 | A1* | 8/2018 | Connell | A43B 13/148 |
| 2019/0320759 | A1 | 10/2019 | Conrad et al. | |
| 2020/0297071 | A1 | 9/2020 | Troufanov et al. | |

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application 63/146,953, filed on Feb. 8, 2021. The disclosure of this prior application is considered part of the disclosure of this application and is hereby incorporated by reference in its entirety.

FIELD

The present disclosure relates generally to an article of footwear and, more particularly, to a sole structure for an article of footwear

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion resistance and traction with the ground surface and may be formed from rubber or other materials that impart durability and wear-resistance, as well as enhance traction with the ground surface.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
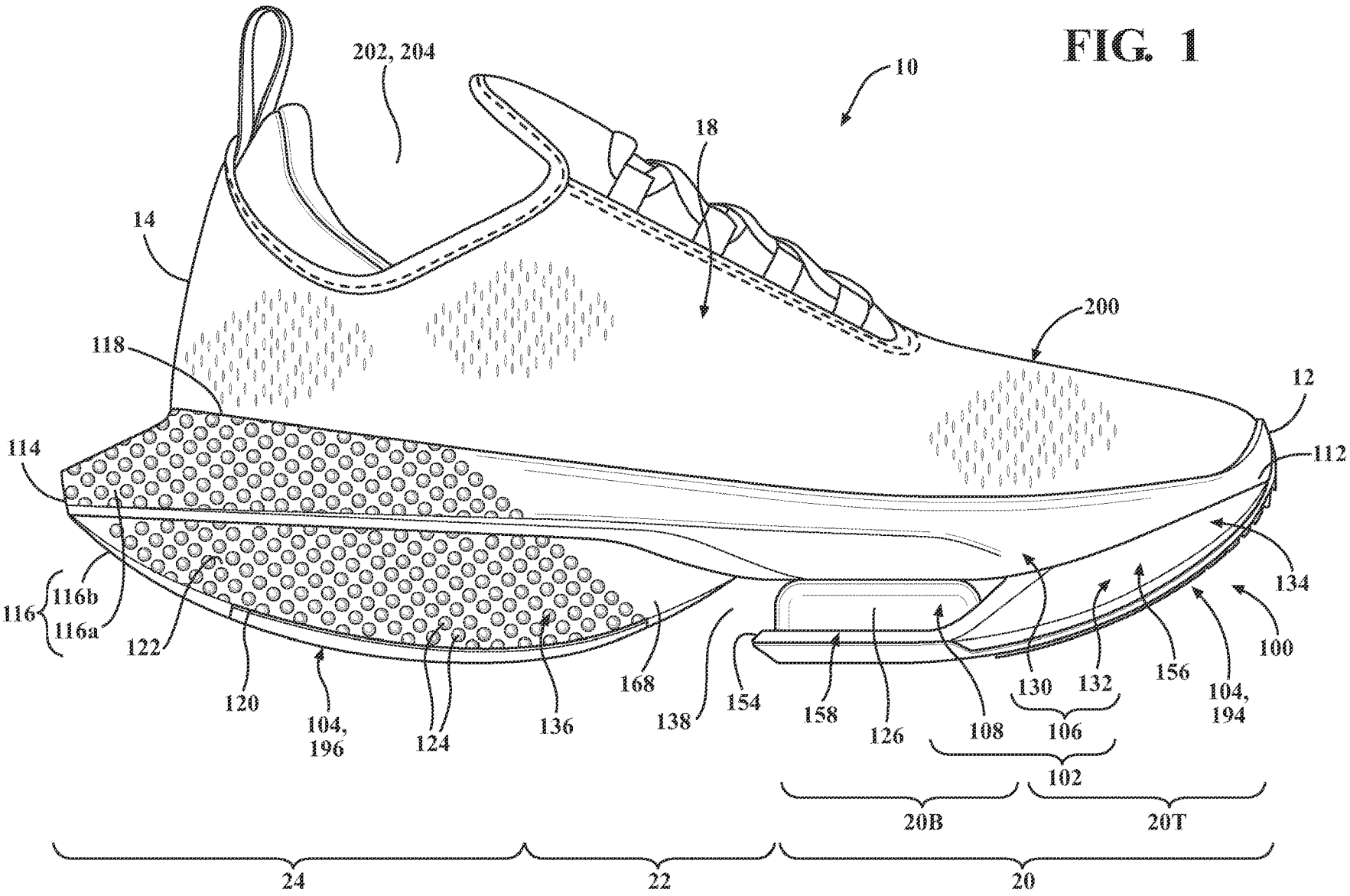
FIG. 1 is a lateral side elevation view of an article of footwear including an example of a sole structure according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear is provided and includes an upper cushion extending from a first end to a second end, a lower cushion having a first segment attached to the upper cushion adjacent to the first end and including a tray extending towards the second end of the upper cushion, and at least one bladder disposed between the tray of the lower cushion and the upper cushion.

Implementations of this aspect of the disclosure may include one or more of the following optional features. A plate may be disposed between the at least one bladder and the upper cushion. A first side of the at least one bladder may be attached to the tray and an opposite second side of the at least one bladder may be attached to the plate.

In one configuration, the lower cushion may include a support portion attached to the upper cushion. In this configuration, the tray may be cantilevered from the support portion.

The at least one bladder may include a first bladder disposed at a medial side of the sole structure and a second bladder disposed at a lateral side of the sole structure. The tray may include a first socket receiving the first bladder and a second socket receiving the second bladder. Additionally or alternatively, at least one of the upper cushion and the lower cushion may include a peripheral side having a plurality of dimples. The dimples may be arranged in a plurality of rows and columns.

An outsole may be disposed on an opposite side of the lower cushion from the at least one bladder. Additionally or alternatively, the tray of the lower cushion may include a foam material.

In another configuration, a sole structure for an article of footwear is provided and includes a cushion arrangement comprising (i) an upper cushion including a top surface and a lower surface formed on an opposite side from the top surface, (ii) a lower cushion including a bottom surface and an upper surface formed on an opposite side from the bottom surface and facing the lower surface of the upper cushion, and (iii) a socket formed between the lower surface of the upper cushion and the upper surface of the lower cushion. At least one bladder is disposed within the socket between the upper cushion and the lower cushion.

Implementations of this aspect of the disclosure may include one or more of the following optional features. A plate may be disposed between the at least one bladder and the upper cushion. A first side of the at least one bladder may be attached to the lower cushion and an opposite second side of the at least one bladder may be attached to the plate.

In one configuration, the lower cushion may include a support portion attached to the upper cushion and a tray cantilevered from the support portion. The tray may define a lower portion of the socket.

The at least one bladder may include a first bladder disposed at a medial side of the sole structure and a second bladder disposed at a lateral side of the sole structure. The upper surface of the lower cushion may include a first socket receiving the first bladder and a second socket receiving the second bladder. Additionally or alternatively, at least one of the upper cushion and the lower cushion may include a peripheral surface having a plurality of dimples. Dimples of the plurality of dimples may be arranged in a plurality of rows and columns.

An outsole may be disposed adjacent to the bottom surface of the lower cushion. Additionally or alternatively, at least one of the upper cushion and the lower cushion may include a foam material.

The details of one or more implementations of the disclosure are set forth in the accompanying drawings and the description below. Other aspects, features, and advantages will be apparent from the description, the drawings, and the claims.

Figure 5:
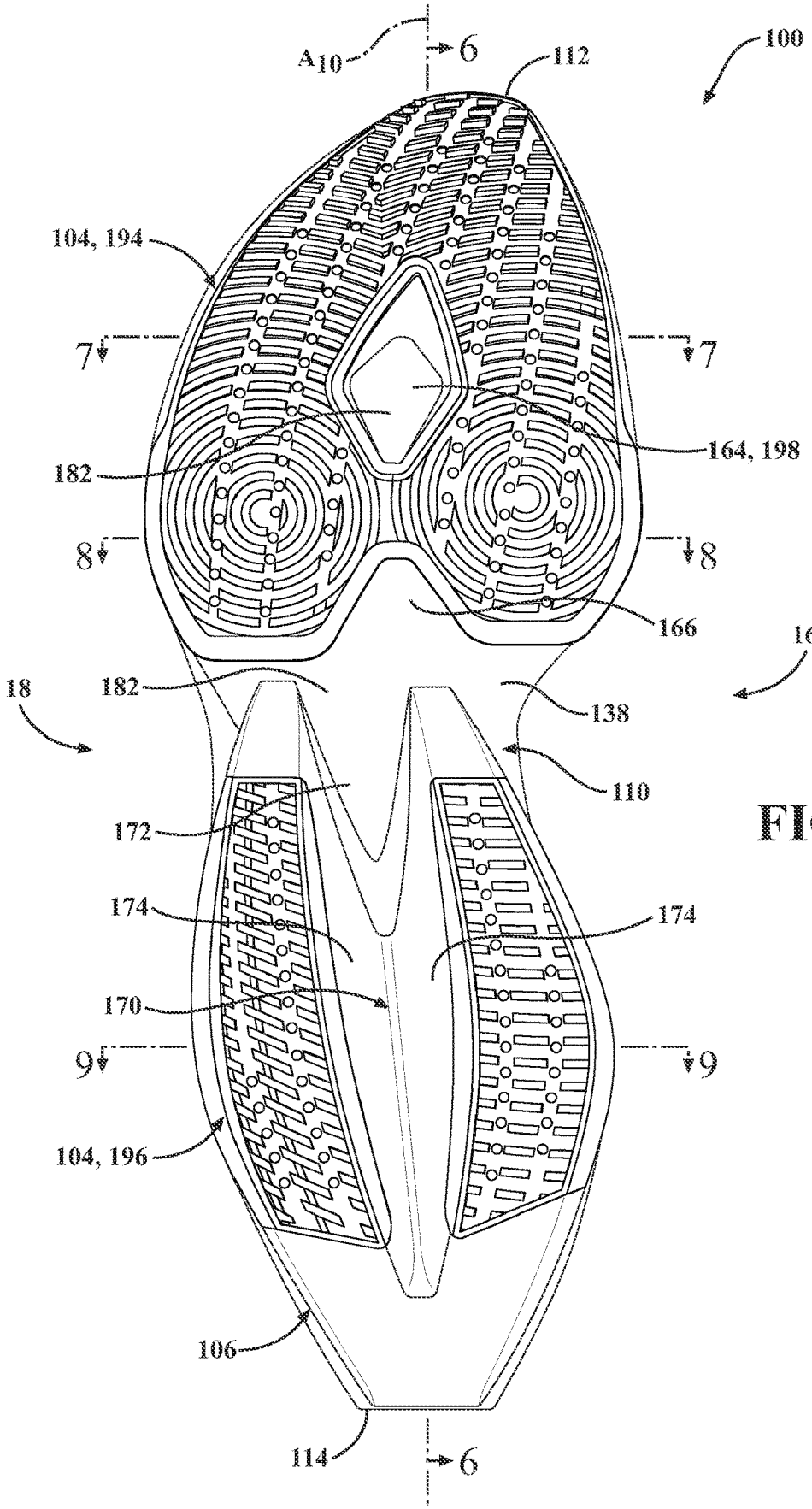
FIG. 5 is a bottom plan view of the sole structure of FIG. 1.
Figure 6:
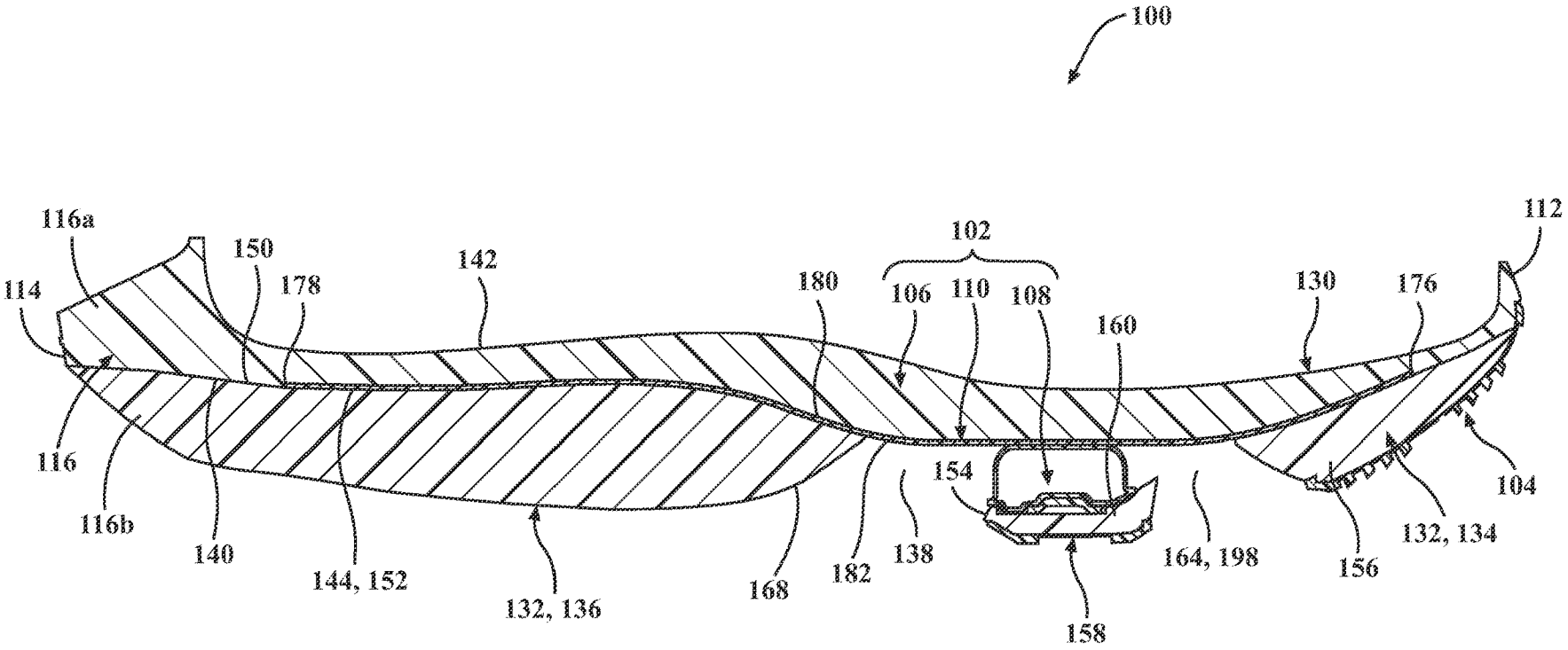
FIG. 6 is a cross-sectional view of the sole structure of FIG. 1, taken along Line 6-6 in FIG. 5.
Figure 7:
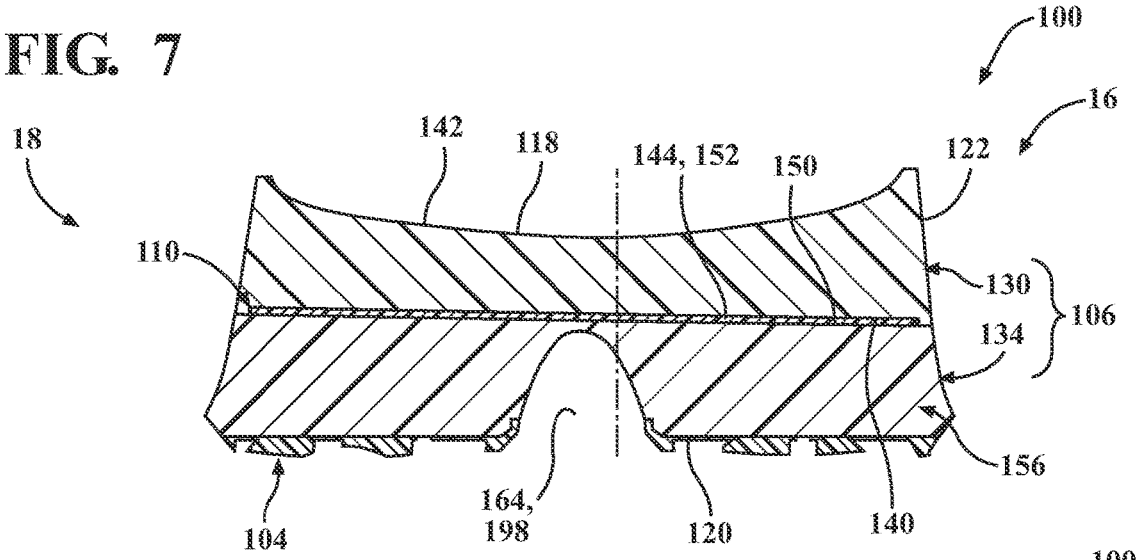
FIG. 7 is a cross-sectional view of the sole structure of FIG. 1, taken along Line 7-7 in FIG. 5.
Figure 8:
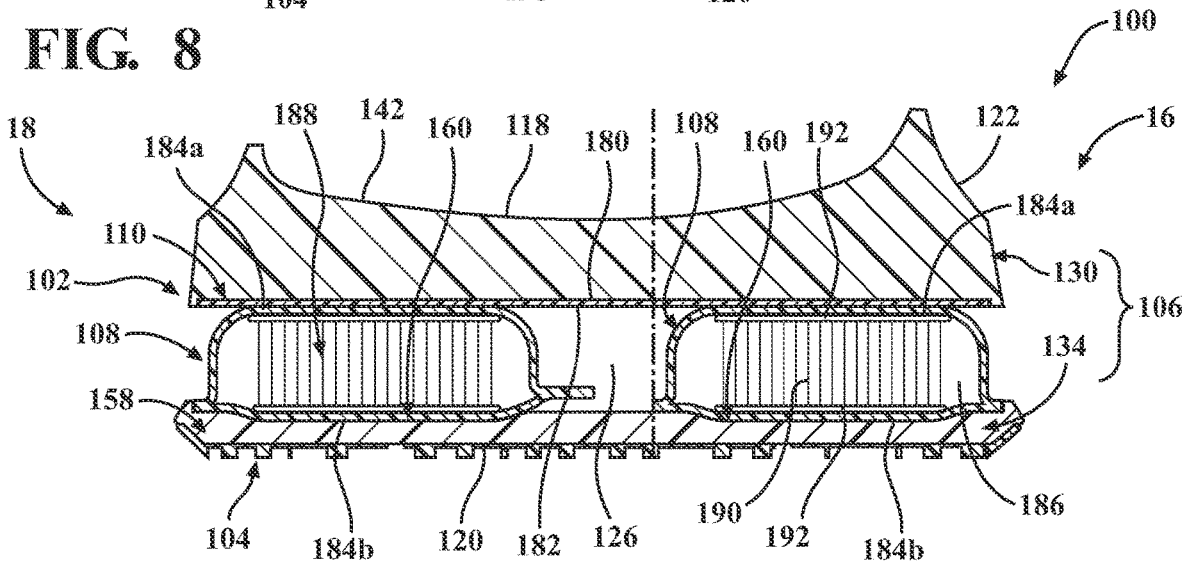
FIG. 8 is a cross-sectional view of the sole structure of FIG. 1, taken along Line 8-8 in FIG. 5.
Figure 9:
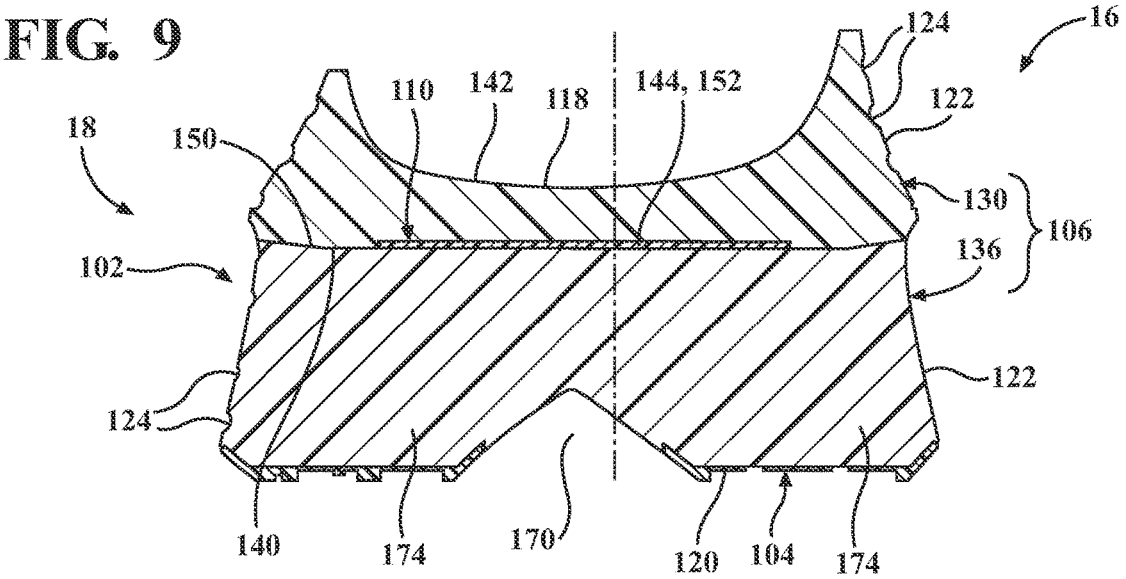
FIG. 9 is a cross-sectional view of the sole structure of FIG. 1, taken along Line 9-9 in FIG. 5.
Figure 10:
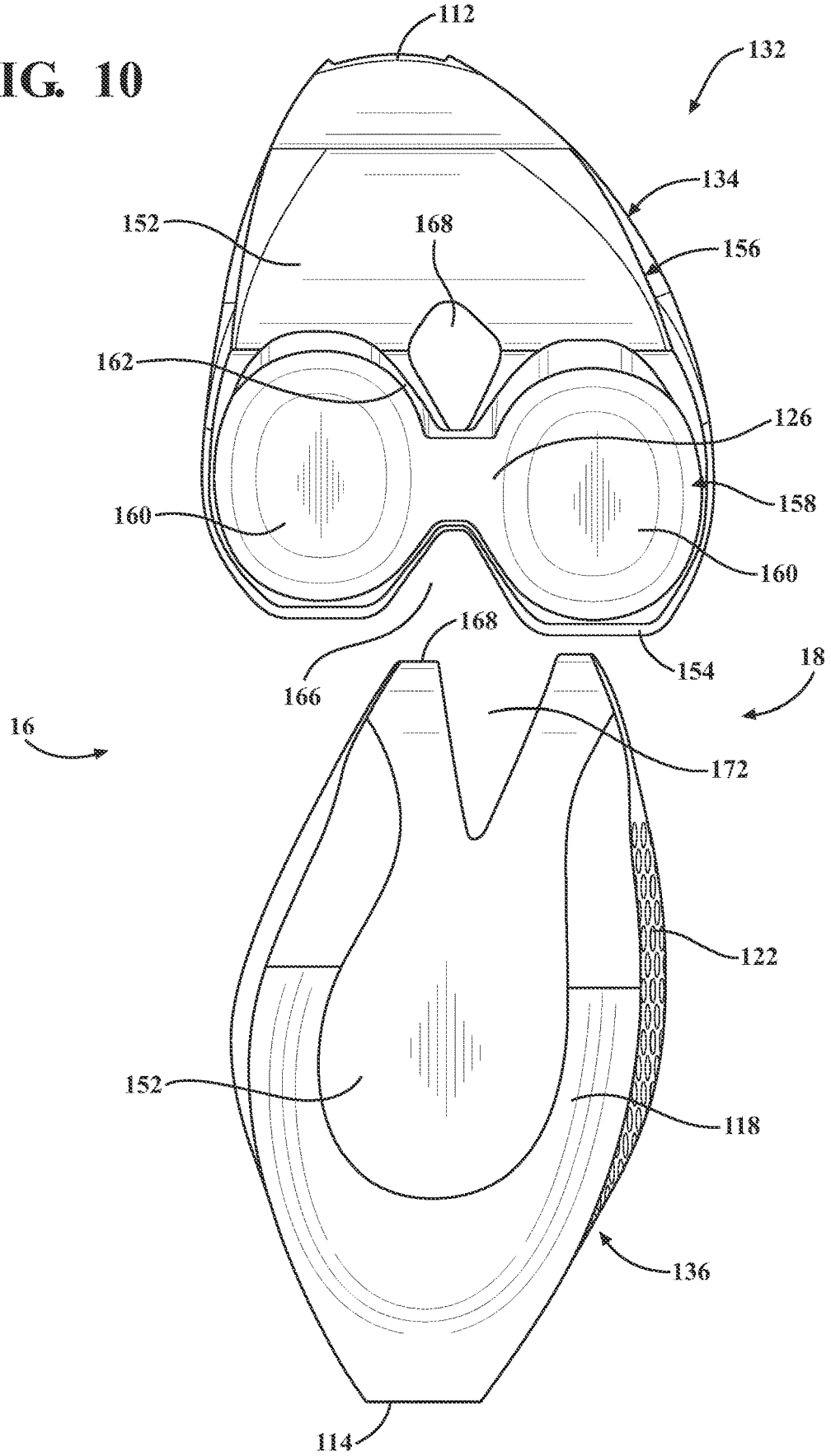
FIG. 10 is a top plan view of a cushioning element of the sole structure of FIG. 1.

Referring to FIG. 1, an article of footwear 10 includes a sole structure 100 and an upper 200 attached to the sole structure 100. The footwear 10 may further include an anterior end 12 associated with a forward-most point of the footwear 10 and a posterior end 14 corresponding to a rearward-most point of the footwear 10. As shown in FIG. 5, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may be subdivided into a toe portion $\mathbf{20}_T$ corresponding with phalanges and a ball portion $\mathbf{20}_B$ associated with metatarsal bones of a foot. The mid-foot region 22 may correspond with an arch area of the foot, and the heel region 24 may correspond with rear portions of the foot, including a calcaneus bone.

The sole structure 100 includes midsole 102 configured to provide cushioning and support and an outsole 104 defining a ground-engaging surface (i.e., contacts the ground during a stance phase of a gait cycle) of the sole structure 100. Unlike conventional sole structures, which include monolithic midsoles and outsoles, the sole structure 100 of the present disclosure is configured as composite structure including a plurality of components joined together. For example, the midsole 102 includes a resilient cushioning element or cushion arrangement 106, one or more bladders 108, and a plate 110. The outsole 104 may also include a plurality of outsole fragments attached to the midsole 102 to provide zonal traction and abrasion resistance.

Figure 2:
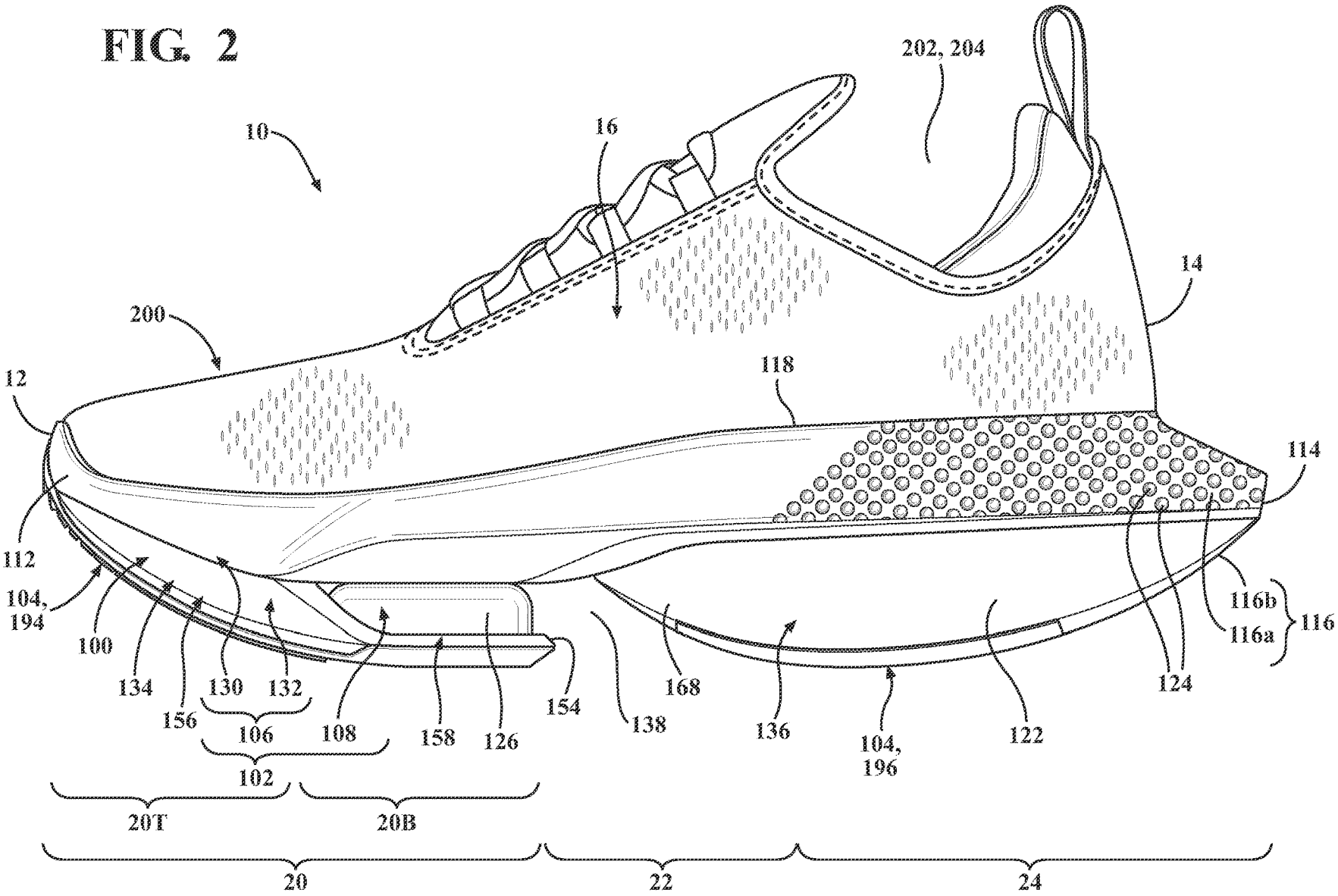
FIG. 2 is a medial side elevation view of the article of footwear of FIG. 1.

With reference to FIGS. 1 and 2, the cushioning element 106 of the midsole 102 extends from a first end 112 at the anterior end 12 of the footwear 10 to a second end 114 at the posterior end 14 of the footwear. Here, the second end 114 may define a projection 116 extending beyond the upper 200 at the posterior end 14. The cushioning element 106 further includes a top side 118 facing the upper 200 and defining a profile of a footbed of the sole structure 100, a bottom side 120 formed on an opposite side of the cushioning element 106 from the top side 118 and defining a profile of the ground-contacting surface of the sole structure 100, and a peripheral side 122 extending from the top side 118 to the bottom side 120 and defining an outer peripheral profile of the sole structure 100.

Optionally, the peripheral side 122 of the cushioning element 106 may include a plurality of dimples 124 arranged along the heel region 24 and between the top side 118 and the bottom side 120. In the illustrated example, the dimples 124 are arranged as an array including a plurality of rows and columns of the dimples 124. When included, the dimples 124 improve aerodynamics of the sole structure by turbulating airflow along the peripheral side 122 to minimize drag as the article of footwear 10 moves through a swing phase of a gait cycle.

As described in greater detail below, the cushioning element 106 includes a receptacle 126 formed within the cushioning element 106 between the top side 118 and the bottom side 120 in the forefoot region 20. The receptacle 126 is configured to receive and support the one or more bladders 108 within the cushioning element 106. In other words, the cushioning element 106 extends above the bladders 108 (i.e., between the bladders 108 and the upper 200) and beneath the bladders 108 (i.e., between the bladders 108 and the outsole 104).

While the cushioning element 106 may be formed as a monolithic structure including a homogenous elastomeric material, the cushioning element 106 of the present example may be defined in terms of a plurality of portions or subcomponents. For example, the cushioning element 106 includes an upper cushioning member or cushion 130 disposed adjacent to the upper 200 and a lower cushioning member or cushion 132 disposed adjacent to the outsole 104. The upper cushioning member 130 extends continuously from the first end 112 of the cushioning element 106 to the second end 114 of the cushioning element 106. Conversely, the lower cushioning member 132 may be fragmented and includes an anterior segment 134 disposed at the first end 112 of the cushioning element 106 and a posterior segment 136 disposed at the second end 114 of the cushioning element 106. As discussed in greater detail below, the anterior segment 134 may be spaced apart from the posterior segment by a gap 138 extending from the medial side 16 to the lateral side 18 in the mid-foot region 22.

Figure 3:
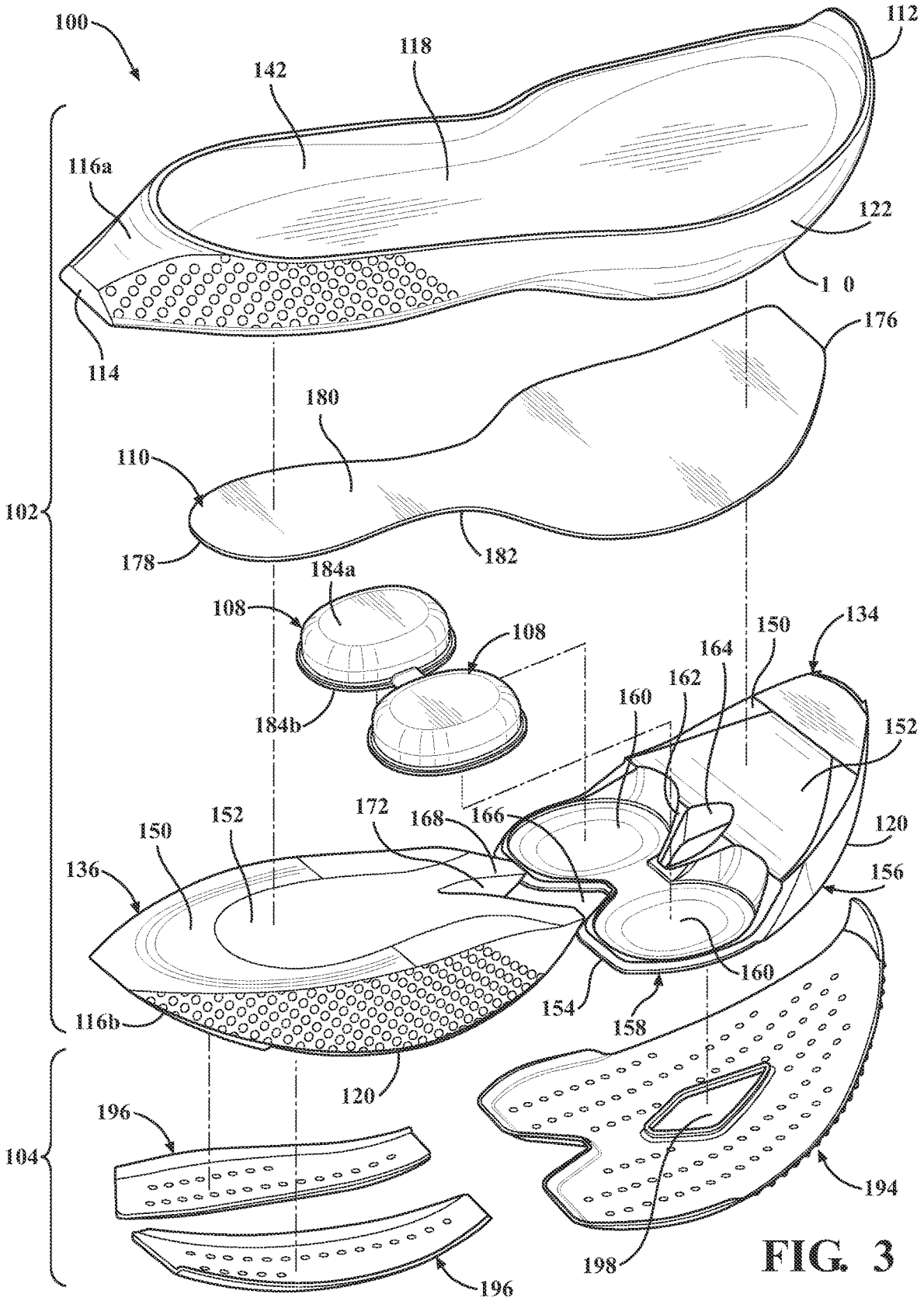
FIG. 3 is an exploded top-lateral perspective view of the sole structure of FIG. 1.
Figure 4:
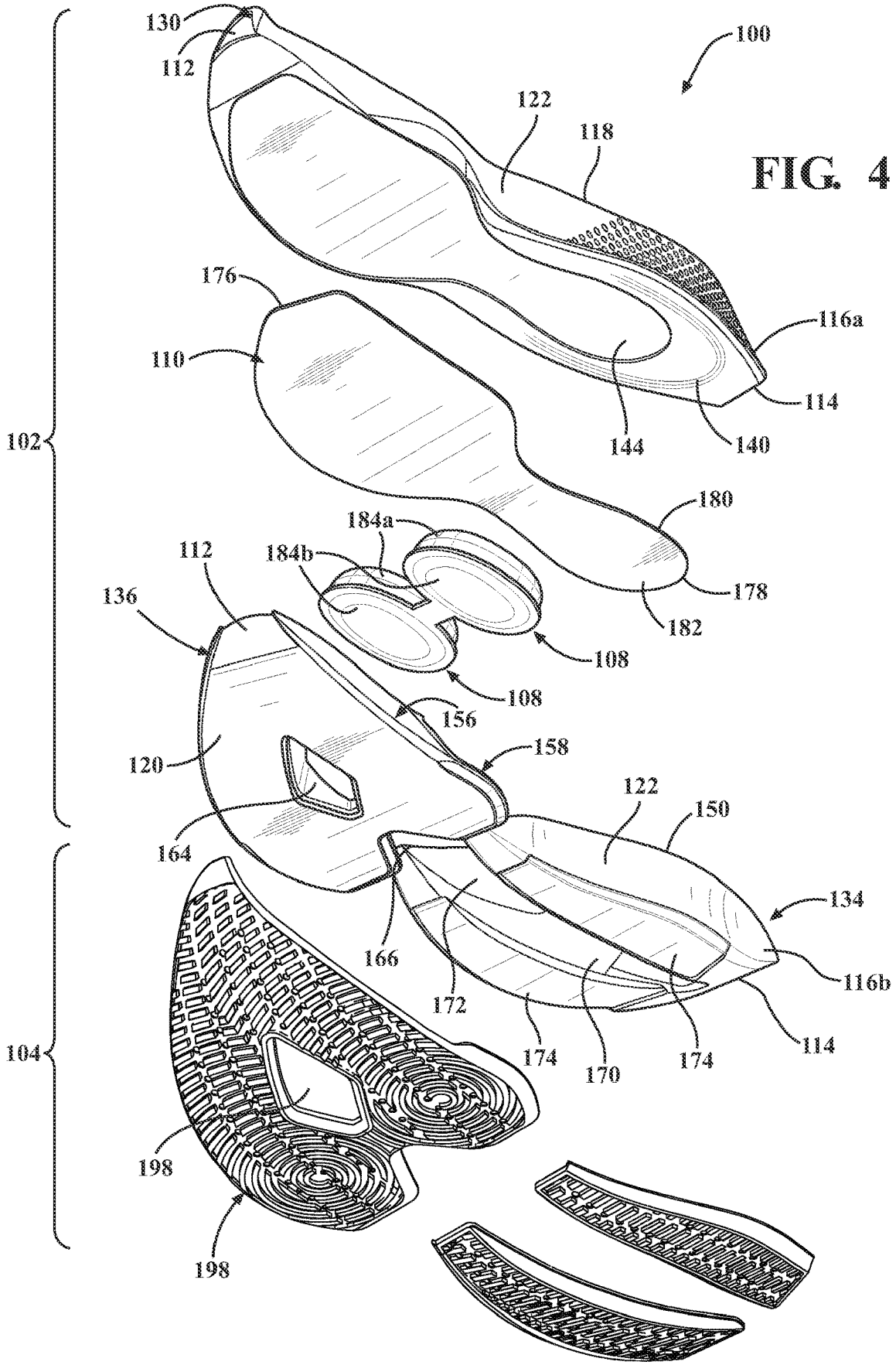
FIG. 4 is an exploded bottom-medial perspective view of the sole structure of FIG. 1.

Referring now to FIGS. 3-9, the upper cushioning member 130 extends continuously from the first end 112 of the cushioning element 106 to the second end 114 of the cushioning element 106. The upper cushioning member 130 includes the top side 118 of the cushioning element 106 and a lower side 140 formed on an opposite side of the upper cushioning member 130 than the top side 118. An upper portion of the peripheral side 122 connects the top side 118 to the lower side 140. As shown in FIG. 3, the top side 118 of the upper cushioning member 130 defines the footbed 142 of the sole structure 100. As shown in FIG. 4, the lower surface of the upper cushioning member 130 includes an upper pocket 144 configured to receive an upper portion of the plate 110 when the sole structure 100 is assembled.

The upper cushioning member 130 also defines an upper portion 116*a* of the posterior projection 116. As shown, the upper portion 116*a* is formed where the top side 118 and the peripheral side 122 extend beyond the footbed 142 at the second end 114. Here, a distance from a portion of the peripheral side 122 on the medial side 16 and a portion of the peripheral side 122 on the lateral side 18 define a width of the projection 116 that tapers along a direction from the footbed 142 to the second end 114. Likewise, the top side 118 and the lower side 140 of the upper cushioning member 130 converge with each other to provide the projection 116 with a tapering thickness along the direction from the footbed 142 to the second end 114.

Referring still to FIGS. 3-9, the lower cushioning member 132 and the segments 134, 136 thereof may be described as including the bottom side 120 of the cushioning element 106. Additionally, the segments 134, 136 may cooperate to define an upper side 150 of the lower cushioning member 132 formed on an opposite side of the lower cushioning member 132 than the bottom side 120. Lower portions of the peripheral side 122 connect the bottom side 120 and the upper side 150 along each of the segments 134, 136. When the sole structure 100 is assembled, the upper side 150 of the lower cushioning member 132 attaches to the lower side 140 of the upper cushioning member 130 to form the cushioning element 106.

The upper side 150 of the lower cushioning member 132 includes a lower pocket 152 configured to receive a lower portion of the plate 110 when the sole structure 100 is assembled. Because the lower cushioning member 132 may be formed as a fragmentary structure including the anterior segment 134 and the posterior segment 136 spaced apart from each other by the gap 138, a first portion of the lower pocket 152 may be formed in the upper surface 150 of the anterior segment 134 and a second portion of the lower pocket 152 may be formed in the upper surface of the posterior segment 136.

The anterior segment 134 of the lower cushioning member 132 is disposed adjacent to the first end 112 of the cushioning element 106. The anterior segment 134 extends from the first end 112 and through the forefoot region 20 to a terminal end 154 adjacent to and facing the mid-foot region 22. The anterior segment 134 includes a support portion 156 extending from the first end 112 and through the toe portion $\mathbf{20}_T$ and a tray 158 extending through the ball portion $\mathbf{20}_B$ from the support portion 156 to the terminal end 154. Generally, a thickness of support portion 156 extends from the upper side 150 to the bottom side 120 such that the support portion 156 provides cushioning and support through the toe portion $\mathbf{20}_T$. Conversely, the tray 158 is formed by a portion of the anterior segment 134 having a reduced thickness relative to the support portion 156. The tray 158 extends from a posterior wall of the support portion 156 to the free-hanging distal end 154 of the anterior segment 134. Accordingly, the tray 158 may be described as being cantilevered from the posterior wall of the support portion 156.

The tray 158 includes one or more recessed sockets 160 formed in the upper side 150 of the cushioning element 106. Each of the one or more sockets 160 is configured to receive a corresponding one of the one or more bladders 108 within the anterior segment 134. Thus, the sockets 160 cooperate with the plate 110 and/or the upper cushioning member 130 to define the receptacle 126 of the cushioning element 106, as discussed previously. In the illustrated example, the tray 158 includes a pair of the sockets 160 recessed from the upper side 150 such that the bladders 108 sit flush with the upper side 150 of the lower cushioning member 132 when the sole structure 100 is assembled. Here, a first one of the sockets 160 is disposed adjacent to the medial side 16 of the sole structure 100 in the ball portion $\mathbf{20}_B$ and a second one of the sockets 160 is disposed adjacent to the lateral side 18 of the sole structure 100 in the ball portion $\mathbf{20}_B$. As shown, the sockets 160 are exposed along the lateral and medial peripheral sides 122 and at the terminal end 154, such that the bladders 108 are displayed and unconstricted along the terminal end 154 and the sides 16, 18 when the sole structure 100 is assembled.

Optionally, the sockets 160 may extend at least partially into a posterior sidewall of the support portion 156, defining a peninsular region 162 in the posterior sidewall of the support portion 156 that extends at least partially between the medial and lateral sockets 160. Here the peninsular region 162 may include an opening 164 extending through the thickness of the anterior segment 134 from the upper side 150 to the bottom side 120. The terminal end 154 may also include a tapered notch 166 opposing the peninsular region 162 across the tray 158 and extending between the sockets 160. Here, the notch 166 and the hollowed peninsular region 162 cooperate to allow the sockets 160 of the tray 158 to move relative to each other when torsional loading is applied to the tray 158 (i.e., during a turning or cutting movement).

With continued reference to FIGS. 3-9, the posterior segment 136 of the lower cushioning member 130 extends through the heel region 24 from the second end 114 of the cushioning element 106 to a terminal end 168 facing the anterior segment 134 in the mid-foot region 22. A portion of the upper side 150 of the lower cushioning member 132 formed by the posterior segment 136 defines a portion of the lower pocket 152 in the mid-foot region 22 and the heel region 24. The bottom side 120 of the posterior segment 136 forms a convex surface having a continuous curvature from the second end 114 to the terminal end 168. Thus, the posterior segment 136 is configured to provide rolling and continuous contact during a heel-strike phase of a gait cycle. Here, the posterior segment 136 forms a lower portion 116*b* of the projection 116 at the second end 114 of the cushioning element 106. As shown in FIGS. 1 and 2, the curved bottom side 120 of the lower cushioning member 132 converges with the sloped top side 118 of the upper cushioning member 130 to provide the projection 116 with a tapered thickness $T_{116}$ along the direction from the footbed 142 to the second end 114.

The posterior segment 136 includes an elongate channel 170 formed in the bottom side 120 and extending into the heel region 24 from the terminal end 168 of the posterior segment 136. The channel 170 has a tapered or triangular cross section extending from the bottom side 120 to an apex between the bottom side 120 and the upper surface 150. The channel 170 is formed through the terminal end 168 of the posterior segment 136 such that the channel 170 defines a notch 172 extending through the terminal end 168 from the upper surface 150 to the bottom surface. The channel 170 and the notch 172 cooperate to form articulable medial and lateral lobes 174 extending along the length of the posterior segment 136.

As described above, the components 132, 134, 136 of the cushioning element 106 are formed of a resilient polymeric material, such as foam or rubber, to impart properties of cushioning, responsiveness, and energy distribution to the foot of the wearer. In the illustrated example, the upper cushioning member 130 includes a first foam material, the anterior segment 134 of the lower cushioning member 132 includes a second foam material, and the posterior segment 136 of the lower cushioning member 132 includes a third foam material. For example, the upper cushioning member 130 and the anterior segment 134 may include first foam materials providing greater cushioning and impact distribution, while the posterior segment 136 includes a foam material having a greater stiffness in order to provide increased stability to the heel region 24 of the sole structure 100.

Example resilient polymeric materials for the cushioning element 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer)

of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIGS. 3 and 4, the plate 110 extends from a first end 176 in the toe portion $\mathbf{20}_T$ to a second end 178 in the heel region 24. The plate 110 includes a top side 180 and a bottom side 182 formed on an opposite side than the top side 180. A distance from the top side 180 to the bottom side 182 defines a thickness of the plate 110. An outer periphery extends between the top side 180 and the bottom side 182 and defines a peripheral profile of the plate 110, which corresponds to a peripheral profile of the upper and lower pockets 144, 152. The plate 110 may be embedded between the upper cushioning member 130 and/or the lower cushioning member 132, such that the top side 180 of the plate 110 is received in the upper pocket 144 and the bottom side 182 of the plate 110 is received in the lower pocket 152. Here, the first end 176 of the plate 110 is received within a portion of the lower pocket 152 defined by the anterior segment 134 and the second end 178 of the plate 110 is received within a portion of the lower pocket 152 defined by the posterior segment 136. Thus, the bottom side 182 of the plate 110 is exposed (i.e., visible) to the ground surface through the opening 164 in the anterior segment 134 and the gap 138 formed between the anterior segment 134 and the posterior segment 136.

The plate 110 includes a material providing relatively high strength and stiffness, such as polymeric material and/or composite materials. In some examples, the plate 110 is a composite material manufactured using fiber sheets or textiles, including pre-impregnated (i.e., "prepreg") fiber sheets or textiles. Alternatively or additionally, the plate 110 may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other.

In some implementations, the plate 110 includes a substantially uniform thickness. In some examples, the thickness of the plate 110 ranges from about 0.6 millimeters (mm) to about 3.0 mm. In one example, the thickness of the plate 110 is substantially equal to one 1.0 mm. In other implementations, the thickness of the plate 110 is non-uniform such that the plate 110 may have a greater thickness in one region 20, 22, 24 of the sole structure 200 than the thicknesses in the other regions 20, 22, 24.

With particular reference to FIGS. 1-4 and 8, the one or more bladders 108 are shown to include a medial bladder 108 and a lateral bladder 108 received within the receptacle 126 of the cushioning element 106 between the upper cushioning member 130 and the lower cushioning member 132. More specifically, the bladders 108 are received within respective ones of the sockets 160. Thus, the medial bladder 108 is disposed in a first socket 160 proximate to the medial side 16 of the sole structure 100 while the lateral bladder 108 is disposed in a second socket 160 proximate to the lateral side 16 of the sole structure 100.

Each of the bladders 108 may include a pair of barrier layers 184*a*, 184*b* formed and joined together along a peripheral seam to define a chamber 186 within the bladder 108. Here, an upper barrier layer 184*a* defines a top side of the bladder 108 and a lower barrier layer 184*b* defines a bottom side of the bladder 108. When the sole structure 100 is assembled, the lower barrier layer 184*b* is received within one of the sockets 160 of the tray 158 such that the bladder 108 is supported on the foam material of the anterior segment 134. The top side of the upper barrier layer 184*a* is flush with the upper side 150 of the cushioning element 106 and attaches to the bottom side 182 of the plate 110 within the gap 138.

As used herein, the term "barrier layer" (e.g., barrier layers 184*a*, 184*b*) encompasses both monolayer and multilayer films. In some embodiments, one or both of the barrier layers 184*a*, 184*b* are each produced (e.g., thermoformed or blow molded) from a monolayer film (a single layer). In other embodiments, one or both of the barrier layers 184*a*, 184*b* are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 184*a*, 184*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 184*a*, 184*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocyanurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocyanates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 184*a*, 184*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 184*a*, 184*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 184*a*, 184*b* may each independently include alternating sublayers of one or more TPU copolymer materials and one or more EVOH copolymer materials, where the total number of sublayers in each of the barrier layers 184*a*, 184*b* includes at least four (4) sublayers, at least ten (10) sublayers, at least twenty (20) sublayers, at least forty (40) sublayers, and/or at least sixty (60) sublayers.

The fluid-filled chamber 186 can be produced from the barrier layers 184*a*, 184*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 184*a*, 184*b* can be produced by co-extrusion followed by vacuum thermoforming to produce an inflatable chamber 186, which can optionally include one or more valves (e.g., one way valves) that allows the chamber 186 to be filled with the fluid (e.g., gas).

The chamber 186 can be provided in a fluid-filled (e.g., as provided in footwear 10) or in an unfilled state. The chamber 186 can be filled to include any suitable fluid, such as a gas or liquid. In an aspect, the gas can include air, nitrogen ($N_2$), or any other suitable gas. In other aspects, the chamber 186 can alternatively include other media, such as pellets, beads, ground recycled material, and the like (e.g., foamed beads and/or rubber beads). The fluid provided to the chamber 186 can result in the chamber 186 being pressurized. Alternatively, the fluid provided to the chamber 186 can be at atmospheric pressure such that the chamber 186 is not pressurized but, rather, simply contains a volume of fluid at atmospheric pressure.

The fluid-filled chamber 186 desirably has a low gas transmission rate to preserve its retained gas pressure. In some embodiments, the fluid-filled chamber 186 has a gas transmission rate for nitrogen gas that is at least about ten (10) times lower than a nitrogen gas transmission rate for a butyl rubber layer of substantially the same dimensions. In an aspect, fluid-filled chamber 186 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 184*a*, 184*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

The chamber 186 of each of the bladders 108 may receive a tensile element 188 (FIG. 8) therein. Each tensile element 188 may include a series of tensile strands 190 extending between an upper tensile sheet 192 and a lower tensile sheet 192. The upper tensile sheet 192 may be attached to a first one of the barrier layers 184*a* while the lower tensile sheet 192 may be attached to a second one of the barrier layers 184*b*. In this manner, when the chamber 186 receives the pressurized fluid, the tensile strands 190 of the tensile element 188 are placed in tension. Because the upper tensile sheet 192 is attached to the upper barrier layer 184*a* and the lower tensile sheet 192 is attached to the lower barrier layer 184*b*, the tensile strands 190 retain a desired shape of the bladders 108 when the pressurized fluid is injected into the chambers 186.

The outsole 104 is formed of a resilient polymeric material and is attached to the bottom side 120 of the lower cushioning member 132. In the illustrated example, the outsole 104 includes a forefoot segment 194 attached to the bottom side 120 of the anterior segment 134 and a pair of heel segments 196 respectively attached to the bottom side 120 each of the lobes 174. Optionally, the forefoot segment 194 of the outsole 104 includes an aperture 198 formed therethrough, which corresponds to the opening 164 formed through the anterior segment 134 of the lower cushioning member 132. Thus, the bottom side 182 of the plate 110 is exposed through the outsole opening 198 and the cushioning element opening 164.

The upper 200 forms an enclosure having plurality of components that cooperate to define an interior void 202 and an ankle opening 204, which cooperate to receive and secure a foot for support on the sole structure 200. The upper 200 may be formed from one or more materials that are stitched or adhesively bonded together to define the interior void 202. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The following Clauses provide an exemplary configuration for an article of footwear and sole structure described above.

Clause 1. A sole structure for an article of footwear, the sole structure comprising an upper cushion extending from a first end to a second end, a lower cushion having a first segment attached to the upper cushion adjacent to the first end and including a tray extending towards the second end of the upper cushion, and at least one bladder disposed between the tray of the lower cushion and the upper cushion.

Clause 2. The sole structure of Clause 1, further comprising a plate disposed between the at least one bladder and the upper cushion.

Clause 3. The sole structure of Clause 2, wherein a first side of the at least one bladder is attached to the tray and an opposite second side of the at least one bladder is attached to the plate.

Clause 4. The sole structure of any of the preceding Clauses, wherein the lower cushion includes a support portion attached to the upper cushion, the tray being cantilevered from the support portion.

Clause 5. The sole structure of any of the preceding Clauses, wherein the at least one bladder includes a first bladder disposed at a medial side of the sole structure and a second bladder disposed at a lateral side of the sole structure.

Clause 6. The sole structure of Clause 5, wherein the tray includes a first socket receiving the first bladder and a second socket receiving the second bladder.

Clause 7. The sole structure of any of the preceding Clauses, wherein at least one of the upper cushion and the lower cushion includes a peripheral side having a plurality of dimples.

Clause 8. The sole structure of Clause 7, wherein the dimples are arranged in a plurality of rows and columns.

Clause 9. The sole structure of any of the preceding Clauses, further comprising an outsole disposed on an opposite side of the lower cushion from the at least one bladder.

Clause 10. The sole structure of any of the preceding Clauses, wherein the tray of the lower cushion includes a foam material.

Clause 11. A sole structure for an article of footwear, the sole structure comprising a cushion arrangement comprising (i) an upper cushion including a top surface and a lower surface formed on an opposite side from the top surface, (ii) a lower cushion including a bottom surface and an upper surface formed on an opposite side from the bottom surface and facing the lower surface of the upper cushion, and (iii) a socket formed between the lower surface of the upper cushion and the upper surface of the lower cushion. At least one bladder is disposed within the socket between the upper cushion and the lower cushion.

Clause 12. The sole structure of Clause 11, further comprising a plate disposed between the at least one bladder and the upper cushion.

Clause 13. The sole structure of Clause 12, wherein a first side of the at least one bladder is attached to the lower cushion and an opposite second side of the at least one bladder is attached to the plate.

Clause 14. The sole structure of any of the preceding Clauses, wherein the lower cushion includes a support portion attached to the upper cushion and a tray cantilevered from the support portion and defining a lower portion of the socket.

Clause 15. The sole structure of any of the preceding Clauses, wherein the at least one bladder includes a first bladder disposed at a medial side of the sole structure and a second bladder disposed at a lateral side of the sole structure.

Clause 16. The sole structure of Clause 15, wherein the upper surface of the lower cushion includes a first socket receiving the first bladder and a second socket receiving the second bladder.

Clause 17. The sole structure of any of the preceding Clauses, wherein at least one of the upper cushion and the lower cushion includes a peripheral surface having a plurality of dimples.

Clause 18. The sole structure of Clause 17, wherein dimples of the plurality of dimples are arranged in a plurality of rows and columns.

Clause 19. The sole structure of any of the preceding Clauses, further comprising an outsole disposed adjacent to the bottom surface of the lower cushion.

Clause 20. The sole structure of any of the preceding Clauses, wherein at least one of the upper cushion and the lower cushion includes a foam material.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

an upper cushion extending from a first end to a second end;

a lower cushion, comprising:

a first cushion attached to the upper cushion adjacent to the first end and including a tray extending towards the second end of the upper cushion to a terminal end, and a second cushion attached to the upper cushion and spaced from the first cushion by a gap, the tray of the first cushion opposing the second cushion across the gap; and at least one bladder including an anterior end and a posterior end supported between the tray of the first cushion and the upper cushion, the terminal end of the tray aligning with or extending beyond the posterior end of the at least one bladder.

2. The sole structure of claim 1, further comprising a plate disposed between the at least one bladder and the upper cushion.

3. The sole structure of claim 2, wherein a first side of the at least one bladder is attached to the tray and an opposite second side of the at least one bladder is attached to the plate.

4. The sole structure of claim 1, wherein the lower cushion includes a support portion attached to the upper cushion, the tray being cantilevered from the support portion.

5. The sole structure of claim 1, wherein the at least one bladder includes a first bladder disposed at a medial side of the sole structure and a second bladder disposed at a lateral side of the sole structure.

6. The sole structure of claim 5, wherein the tray includes a first socket receiving the first bladder and a second socket receiving the second bladder.

7. The sole structure of claim 1, wherein at least one of the upper cushion and the lower cushion includes a peripheral side having a plurality of dimples.

8. The sole structure of claim 7, wherein the dimples are arranged in a plurality of rows and columns.

9. The sole structure of claim 1, further comprising an outsole disposed on an opposite side of the lower cushion from the at least one bladder.

10. The sole structure of claim 1, wherein the tray of the lower cushion includes a foam material.

11. A sole structure for an article of footwear, the sole structure comprising:

a cushion arrangement comprising:

i. an upper cushion including a top surface and a lower surface formed on an opposite side from the top surface, ii. a lower cushion including a first cushion and a second cushion each having a bottom surface and an upper surface formed on an opposite side from the bottom surface and facing the lower surface of the upper cushion, iii. a socket formed between the lower surface of the upper cushion and the upper surface of the first cushion, and iv. a gap separating the first cushion and the second cushion; and at least one bladder including a top surface and a bottom surface, the bottom surface of the at least one bladder contacting and being supported on the upper surface of the first cushion within the socket.

12. The sole structure of claim 11, further comprising a plate disposed between the at least one bladder and the upper cushion.

13. The sole structure of claim 12, wherein a first side of the at least one bladder is attached to the lower cushion and an opposite second side of the at least one bladder is attached to the plate.

14. The sole structure of claim 11, wherein the lower cushion includes a support portion attached to the upper cushion and a tray cantilevered from the support portion and defining a lower portion of the socket.

15. The sole structure of claim 11, wherein the at least one bladder includes a first bladder disposed at a medial side of the sole structure and a second bladder disposed at a lateral side of the sole structure.

16. The sole structure of claim 15, wherein the upper surface of the lower cushion includes a first socket receiving the first bladder and a second socket receiving the second bladder.

17. The sole structure of claim 11, wherein at least one of the upper cushion and the lower cushion includes a peripheral surface having a plurality of dimples.

18. The sole structure of claim 17, wherein dimples of the plurality of dimples are arranged in a plurality of rows and columns.

19. The sole structure of claim 11, further comprising an outsole disposed adjacent to the bottom surface of the lower cushion.

20. The sole structure of claim 11, wherein at least one of the upper cushion and the lower cushion includes a foam material.

* * * * *